United States Patent [19]

Carnegie

[11] 4,442,835

[45] Apr. 17, 1984

[54] DEEP DIVING BREATHING SYSTEMS

[75] Inventor: Alistair L. Carnegie, Yeovil, England

[73] Assignee: Normalair-Garrett (Holdings) Limited, Yeovil, England

[21] Appl. No.: 327,084

[22] Filed: Dec. 3, 1981

[30] Foreign Application Priority Data

Dec. 4, 1980 [GB] United Kingdom ..... 8038977

[51] Int. Cl.[3] ..... A62B 7/00

[52] U.S. Cl. ..... 128/201.27; 128/205.24; 128/201.28; 137/81.2

[58] Field of Search ..... 128/201.27, 201.28, 128/205.19, 204.26, 201.11, 201.21; 137/81.2, 493

[56] References Cited

U.S. PATENT DOCUMENTS 3,965,892 6/1976 Colston et al. ..... 128/201.27
4,182,324 1/1980 Hills ..... 128/201.27

FOREIGN PATENT DOCUMENTS 917423 2/1963 United Kingdom ..... 137/493
1321566 6/1973 United Kingdom ..... 137/493

*Primary Examiner*—Henry J. Recla
*Assistant Examiner*—Karin M. Reichle
*Attorney, Agent, or Firm*—Larson and Taylor

[57] ABSTRACT

A deep diving breathing system in which a breathable gas mixture is circulated through a diving helmet by a push-pull pump includes an inlet flow control valve, an outlet gas flow regulator valve, and a bleed valve. The bleed valve operates in response to the pressure of gas flowing from the outlet gas flow regulator valve to bleed gas from a gas supply line upstream of the inlet flow control valve. The system facilitates diving operations from a diving bell at a range of depths and recovery of helium in a helium-oxygen breathing gas mixture.

9 Claims, 10 Drawing Figures

DEEP DIVING BREATHING SYSTEMS

This invention relates to deep diving breathing systems, and is particularly concerned with pressure control means for a deep diving breathing system in which gas is supplied to and withdrawn from the helmet of a diver by a push-pull pump.

A deep diving breathing system incorporating a push-pull pump for circulating a breathable gas mixture including helium through the system by way of the diver's helmet provides a recirculation system whereby the loss of helium from the system is minimal. However, an operational problem arises in regard to gas conservation when the diver is operating out of a diving bell which provides the breathable gas source for the push-pull pump. Thus, as the diver rises above the level of the diving bell the required gas pressure in the diver's helmet falls below the pressure in the bell so that gas delivered by the push-pull pump expands on entering the helmet, eventually attaining a volume beyond the capacity of the pull pump to return to the bell and requiring provision of arrangements to relieve the excess pressure that would otherwise develop in the diver's helmet. In view of the high cost of helium, it is uneconomic to allow the excess gas to be discharged to the sea by a pressure relief valve on the helmet.

This problem may be overcome by bleeding gas from the push-pump to within the diving bell so that gas which would otherwise be lost to the sea through a pressure relief valve on the diver's helmet is conserved. The amount of gas, if any, required to be bled from the system depends on the depth at which the bell is located, the location of the diver relative thereto, and the breathing gas flow. In current practice these conditions are required to be detected from the bell and used by an operator within the bell to control a valve so as to bleed an amount of gas appropriate to the pertaining conditions. A particular problem arises in detecting from within the bell the exact height of the diver above the bell so that it is difficult to assess the amount of gas required to be bled from the system.

It is an object of the present invention to provide improvements to deep diving breathing systems that will be advantageous to the safety and to the comfort of a diver operating out of a diving bell.

Accordingly, in meeting this object the present invention provides a deep diving breathing system having push-pull pump means for circulating a breathable gas mixture through a diving helmet and helmet pressure control means comprising inlet valve means for controlling flow of gas from a gas supply line into the helmet, outlet valve means for controlling flow of gas from the helmet to a gas return line, and bleed valve means operable in response to the pressure of gas flowing from the outlet valve means for bleeding gas from the gas supply line upstream of the inlet valve means.

A further object of the invention is the provision of a deep diving breathing system having helmet pressure control means responsive to conditions at a diver operating out of a diving bell to bleed excess gas from the system for return to the bell without the requirement that the location of the diver relative to the diving bell be known.

In meeting this further object the invention provides deep diving apparatus including a diving bell, at least one diving suit having a diving helmet, a breathing system comprising push-pull pump means located on the diving bell for supplying breathable gas mixture by way of a gas supply line to the helmet of a diver operating out of the bell and for returning gas from the helmet to the bell by way of a gas return line, and helmet pressure control means having inlet valve means for controlling the flow of breathable gas from the gas supply line to the helmet, outlet valve means for controlling flow of gas from the helmet to the gas return line, and bleed valve means operable in response to the pressure of gas flowing from the outlet valve means for bleeding gas from the gas supply line upstream of the inlet valve means to a bleed gas return line connected between the bleed valve means and the diving bell.

Preferred bleed valve means comprises a hollow valve body housing a valve-head and diaphragm combination, the diaphragm dividing a chamber within the valve body into two sub-chambers one of which is open to ambient (sea) pressure and the other of which is connected with the outlet of the outlet valve means, the valve-head being movable by the diaphragm to co-operate with a valve seat to control a passage connecting with the gas supply line at or near its junction with the inlet valve means in the sense to open said passage in response to rising pressure at said outlet, in relation to ambient pressure. Thus while the pressure at the outlet of the outlet valve means is below ambient indicating that the pull-pump is coping with the flow of gas to the helmet, the valve-head is held in a closing position on the valve seat by the action of ambient (sea) pressure on the diaphragm. However, should the pressure at the outlet of the outlet valve means, relative to ambient, change towards becoming positive with respect to ambient the resultant change in differential pressure acting on the diaphragm will cause or allow movement of the valve-head off of the valve seat, thereby allowing supply gas to bleed from the gas supply line to a bleed return line connected between the bleed valve means and the diving bell. Preferably the valve-head or the diaphragm is spring-biassed in the valve-opening direction so that a predetermined minimum depression (e.g.—2 p.s.i.) of the outlet pressure relative to ambient is required to maintain the valve-head in its closing position on the valve seat.

In facilitating the ability of a diver to work at a low level of physical stress it is essential that the effort required by him to breathe should be minimal and, therefore, that little or no effort should be required of the diver in controlling both the pressure and flow of gas through his helmet. Thus a gas control valve for use as the inlet valve means in the present invention is required to be of a simple construction and such as to offer little or no resistance to breathing effort, by having low dynamic mass.

A gas control valve suitable for use as the inlet valve means of the present invention comprises a hollow valve body having a gas inlet port and a gas outlet port, an annular valve seat and an annular land formed internally of the valve body, a valve member supported within the valve body by flexible wall means near to each end of the valve member, a valve head and an annular land formed on the valve member for co-operation with the annular valve seat and the annular valve land, respectively, of the hollow valve body, a differential pressure sensing device at one end of said valve body divided by a flexible diaphragm into an ambient pressure chamber and a control pressure chamber, the control pressure chamber being in part defined by the flexible wall means supporting the valve member at that end of the valve body, and means for communicating the control pressure chamber with a space to which gas flowing through the valve is supplied.

A breathing system including push-pull pump means must be provided with means for protecting the diver against a depression (i.e. negative pressure) appearing in his helmet should a breakdown occur in the supply system, such as would be the case if the push pump failed, and it is convenient for the outlet valve means to provide this safeguard, for instance in the manner disclosed in U.S. Pat. No. 4,182,324.

A preferred form of outlet valve means in accordance with the present invention comprises a gas flow regulator valve having a tubular member closed at one end and providing a plurality of generally radial flow paths through which gas flows in passing from a valve inlet to a valve outlet, a flexible sleeve member engageable around a cylindrical surface of the tubular member, means for exposing the flexible sleeve member to ambient water pressure on the surface thereof which is away from the cylindrical surface of the tubular member, and means for occluding an arcuate portion of the radial flow paths through the tubular member.

In operation of the valve, ambient water pressure acts on the flexible sleeve member, which is preferably formed from elastomeric material, to hold it against the tubular member so tending to close the radial flow paths through the tubular member. Pull pump suction pressure is effective at the valve outlet and tends to draw the flexible sleeve member onto the tubular member. The valve inlet is subject to the pressure of gas flowing from the diving helmet, which pressure would normally have to overcome the effect of both ambient water pressure and pull pump suction pressure in order to lift the flexible sleeve member off of the tubular member in order to commence opening of the radial flow paths through the tubular member. However, the valve in the present invention has an arcuate portion of the radial flow paths occluded so that over this area the gas pressure has only to overcome ambient water pressure to lift the flexible sleeve member and, as the gas pressure increases, the sleeve member continues to lift circumferentially until a radial flow path area appropriate to the flow of gas is opened.

The invention will now be further described by way of example with reference to the accompanying drawings in which:

FIG. 1 schematically illustrates a diving helmet and associated pressure control means which forms part of a deep diving breathing system according to an embodiment of the invention;

Figure 1:
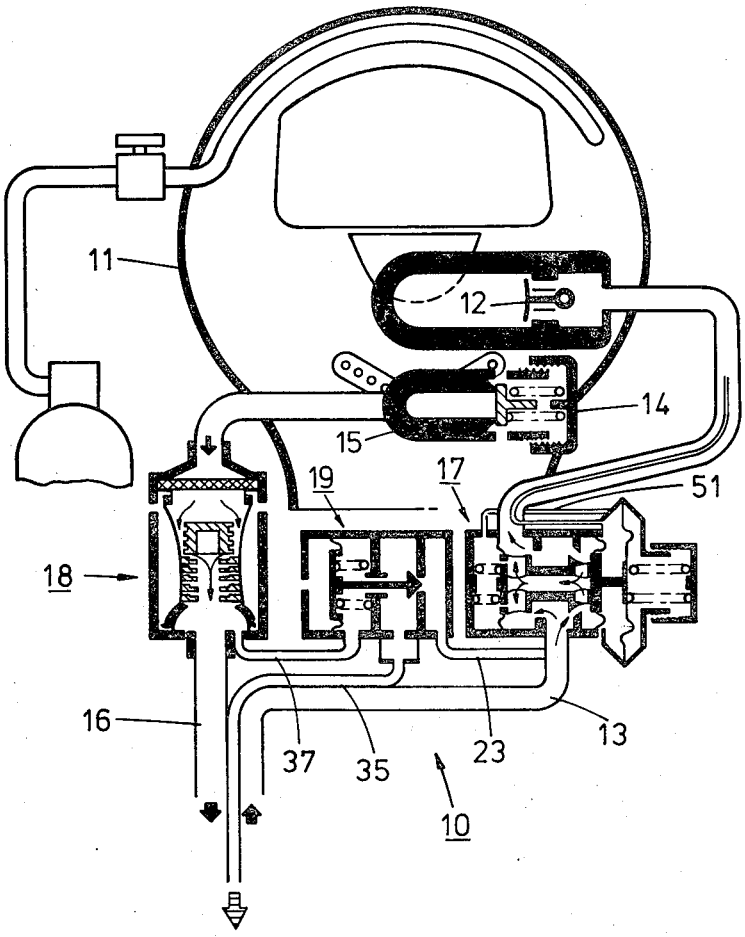

Referring to FIG. 1, pressure control means 10 for a deep diving breathing system including a push-pull pump (not shown) comprises inlet valve means, outlet valve means and bleed valve means situated on, or in the vicinity of, a diving helmet 11 having a non-return valve 12 terminating a breathable gas supply line 13 at its entry to the helmet 11 and a pressure relief valve 14, conveniently formed in a helmet outlet connection 15 which connects with a gas return line 16. In this embodiment the inlet valve means comprises an inlet flow control valve 17 included in the supply line 13, the outlet valve means comprises an outlet gas flow regulator valve 18 incorporated in the return line 16 close to the outlet connection 15, and the bleed valve means comprises a bleed valve 19 for controlling removal of gas from the delivery line 13, at the upstream side of the inlet flow control valve 17.

Figure 2:
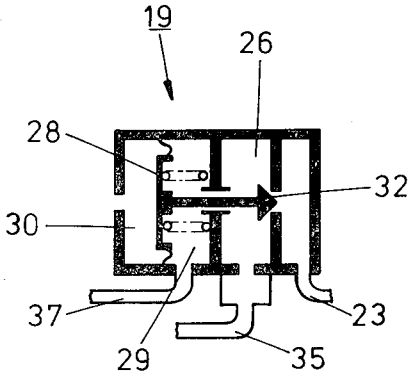
Figure 5:
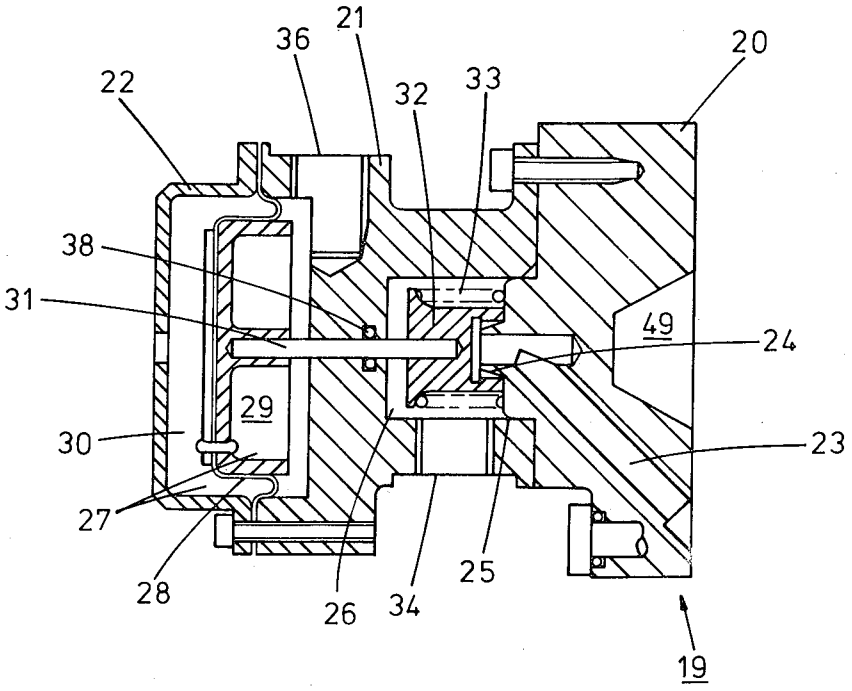
FIGS. 5, 6, 7 are sectional views of practical valves corresponding to the valve means illustrated in FIGS. 2, 3 and 4, respectively.

The bleed valve 19, also shown in FIG. 2 and illustrated in detail in FIG. 5, is a poppet valve which is fluidly operated by differential pressure and comprises an elongate body assembly including an inlet element 20, a body portion 21 and a cover 22. The inlet element 20 provides fluid connection, by way of an internal passage 23 and a duct or tubing (best represented in FIGS. 1 and 2) between the breathable gas supply line 13 and the interior of the body assembly. The internal passage terminates in a conical, annular valve seat 24 raised on the plane surface of a spigot 25 that forms part of the profile of the element 20 and is arranged for co-axial alignment with the longitudinal axis of the body assembly. The spigot 25 locates in the entry of a substantially blind bore in the body portion 21 and creates a valve chamber 26. The end-wall of the valve chamber 26 is pierced by a small bore that houses an annular, low friction PTFE seal 38 and is aligned concentrically of the valve seat 24. The outer face of the end wall of the valve chamber 26 is of considerably larger diameter than the inner face and is peripherally flanged to form one half of a pressure chamber 27, which is completed by another half in the form of the cover 22. The cover 22 is perforated, for the admission of water, and secured by a ring of bolts around the flanges by which means an impermeable rolling diaphragm 28, that divides the chamber 27 into two sub-chambers 29, 30, is also secured. A major portion of diaphragm 28, in usual manner, is stiffened by a circular flanged plate and this carries a push-rod 31 at its centre that is of sufficient length to reach into the valve chamber 26 and of such diameter as to be a sliding fit in the small bore through the dividing wall. Within the valve chamber 26 the push-rod 31 engages a valve-head 32 and is of such length that with the diaphragm 28 in, substantially, a null position the valve-head is in the closed position. A compression spring 33 bears on an annular flange of the valve-head 32 and urges it towards opening when valve closing differential pressure is less than 2 psig. The valve-head 32 includes a resilient sealing element which, when the valve is closed, is pressed onto the valve-seat 24, however, in order that it shall not become damaged in the event of excessive closing pressure being applied the valve-head 32 is formed with a skirt that circumscribes the base of the conical, raised valve seat. An outlet 34 is provided in the wall of the body portion 21 for communicating the valve chamber 26 with a bleed return line 35 (see FIGS. 1 and 2) that connects with a region in a diving bell that is, substantially, at the pressure of the push-pump gas source. The sub-chamber 29 is fluidly connected to the downstream side of the outlet gas flow regulator 18 through connection 36 and a sensing line 37 (see FIGS. 1 and 2).

Figure 3:
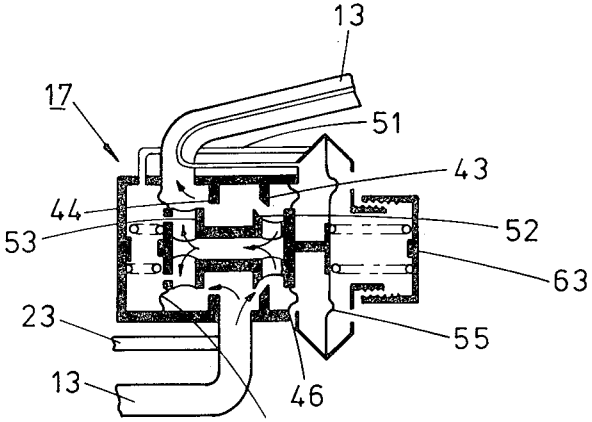
FIGS. 2, 3, 4 are individual schematic illustrations of bleed valve means, inlet valve means, and outlet valve means, respectively, for the pressure control means shown in FIG. 1.
Figure 6:
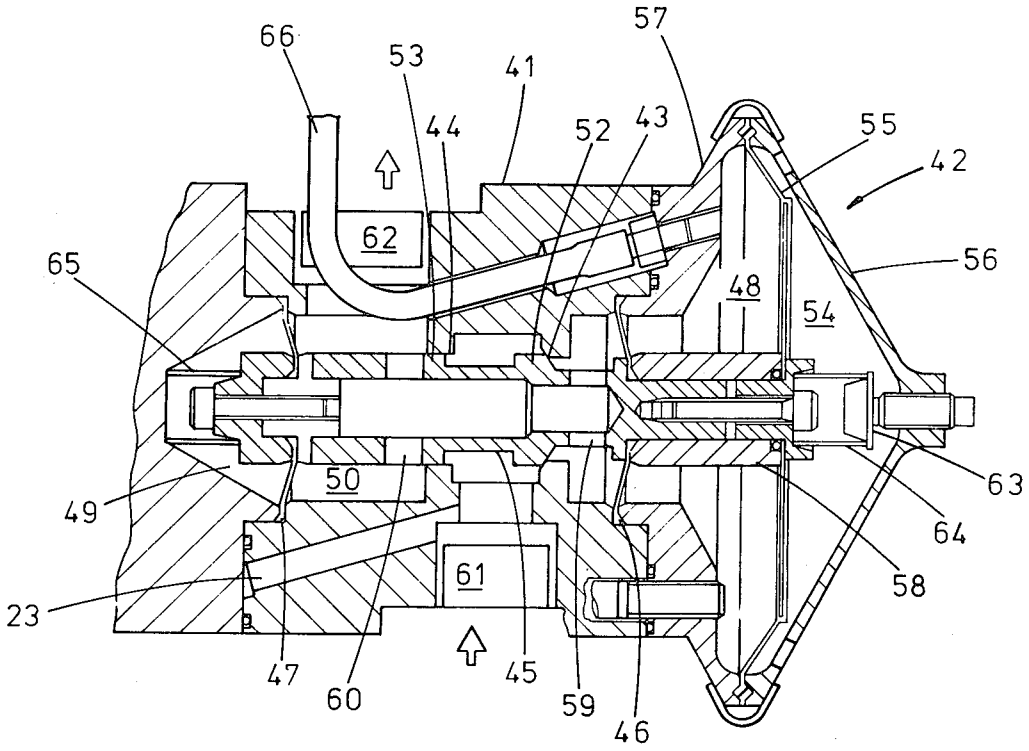

In this embodiment the inlet flow control valve 17, also shown in FIG. 3 and illustrated in detail in FIG. 6, comprises a hollow valve body 41 having a differential pressure sensing device 42 attached to one end. The hollow body 41 interiorly provides, in axial spaced relationship, an annular valve seat 43 and an annular land 44. A lightweight combination poppet and spool valve member 45 is freely supported within the body 41 by flexible wall means comprising two impermeable flexible membranes 46, 47 that are disposed outboard of the annular valve seat and land 43, 44 respectively. The membrane 46 closes one end of the body 41 and provides part of a wall of a control pressure chamber 48 of a pressure sensing device 42, whilst the membrane 47 provides a wall separating a balancing chamber 49 from a flow chamber 50, which is formed between the two membranes 46, 47. The control pressure chamber 48 and the balancing chamber 49 are interconnected by a balancing duct or tube 51 shown only in FIG. 1. The combination valve member 45 provides a valve head 52 and a raised annular land 53 that are co-operable, respectively, with the valve seat 43 and the annular land 44 provided within the flow chamber 50. The pressure sensing device 42 comprises a differential pressure chamber formed by the control pressure chamber 48 and an ambient (immersing water) pressure chamber 54, which two chambers are separated by an impermeable flexible diaphragm 55 that is peripherally trapped between the rims of a perforated cover 56 and a flared portion 57 of the valve body 41. The valve member 45 is mechanically secured to the diaphragm 55 by a stud arrangement 58 that spans the control chamber 48 as an axial extension of the valve member 45. When the valve head 52 is seated the land 53 is just entered within its associating land 44 of the flow chamber 50. A radial clearance of nominally 0.005 inch is provided between the lands 44, 53. The valve member 45, within the length of the flow chamber 50, is of hollow construction and has a cross drilling 59, 60 at each end outboard of the valve head 52 and land 53. An inlet for connection 61 to the breathable gas supply line 13 is provided in the wall of the body 41 at a position between the valve seat 43 and the land 44, whilst an outlet 62 is positioned in the wall to the side of the land 44 remote from the seat 43. The perforated cover 56 carries a threaded spring adjuster 63 that is aligned with the axis of the valve member 45 and holds a low rate compression spring 64 against the stud arrangement 58. Another low rate compression spring 65 is located in the balancing chamber 49 in axial opposition to spring 64. A helmet pressure sensing tube 66 is connected to the control pressure chamber 48.

It is convenient in practice to integrate the bodies of the bleed valve 19 and the inlet flow control valve 17 so that the inlet element 20 of the former defines in part the chamber 49 of the latter, whilst the latter provides continuation of duct 23 of the former to connect with the breathable gas delivery line 13 and provide the bleed path therefrom.

Figure 4:
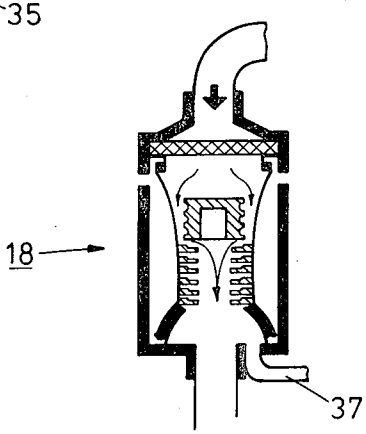
Figure 7:
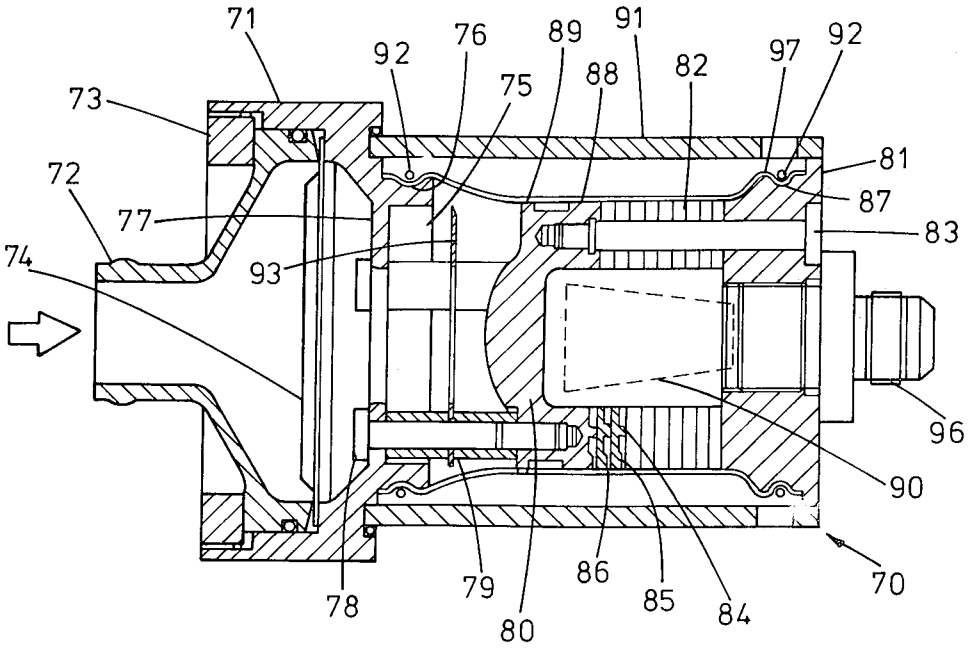
Figure 9:
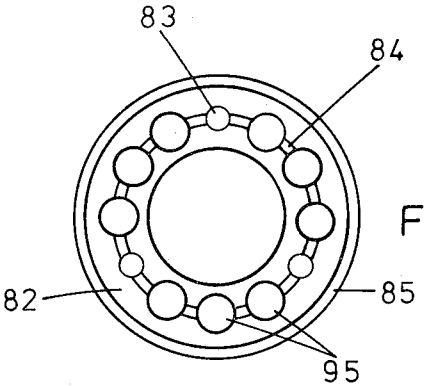
FIGS. 8, 9, 10 illustrate features of the valve shown in FIG. 7.
Figure 8:
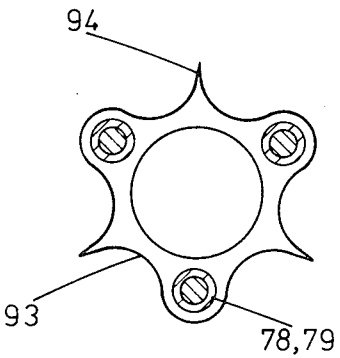
Figure 10:
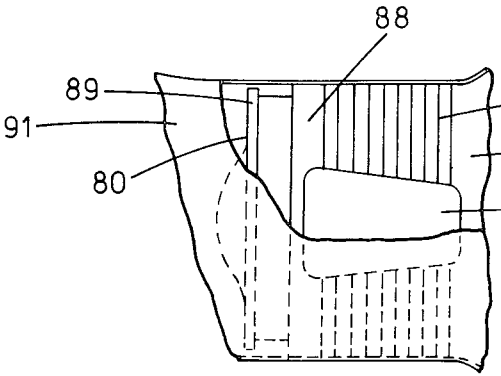

The outlet gas flow regulator valve 18 in this embodiment is provided by an anti-suction valve, shown in FIG. 4 and illustrated in detail in FIG. 7, of a type which utilises a resilient impermeable sleeve over a perforated tubular member. With reference to FIG. 7, the anti-suction valve 70 comprises a principal body element 71 having an enlarged entry into which a hose adaptor 72 is secured by a locking ring 73. A filter element 74 is trapped between the hose adaptor 72 and the body element 71. On its downstream side the body element 71 is of reduced diameter and provides a short section 75 around which is an annular groove 76, and from which depends an annular web 77. The web supports three equally spaced bolts 78 which are sleeved with spacers 79 and this assemblage rigidly locates and carries a flow deflecting member 80 closing one end of a tubular member that provides a weir-like flow path towards an outlet 81 of the valve. The outlet 81 is spaced from the member 80 by a plurality of, say nine, weir elements 82 which are pinched together by three equally spaced bolts 83 that pass through the outlet 81 and weir elements 82 into threaded engagement in the member 80. Each weir element 82 is formed by an annular plate having one plane face and the other face provided with two raised rings 84, 85 that are concentric with the axis of the plate. One raised ring 85 is peripheral of the plate whilst the other 84 is approximately mid-way between the peripheral ring 85 and the internal circumference of the plate. The inner ring 84 is raised from the surface of the plate substantially, 0.020 inches more than the peripheral ring 85. Corresponding rings 84, 85, are provided on the downstream face of the member 80 whilst the upstream face of the outlet 81 is plane so that when the weir elements are assembled with their plane faces abutting the raised rings of their neighbour, a series of peripheral annular slots 86 results. The circumferential continuity of each inner raised ring 84 is broken by a series of holes 95 (reference FIG. 9) centred on the ring 84 and piercing the annular plate, whereby a radial flow path between the weir elements 82 is provided. The outlet 81 is provided with a groove 87 corresponding to groove 76 on the principal body element 71 and these grooves are of a slightly larger diameter than the external diameter of the weir elements 82. The member 80 is formed with a shallow groove on its outer circumferential surface with the upstream wall of the groove being of slightly smaller diameter than its complementary wall, thereby providing a principal circumferential sealing surface 88 downstream of a second, similar, surface 89. A very thin shim plate 90 formed to the curvature of the outside diameter of the weir elements 82 and the member 80 is bonded thereto and occludes a small arcuate area of the entry to each slot 86 formed between the weir elements. The shim plate 90 is tapered in its width in the direction of flow through the valve, thus presenting a larger surface area at its upstream end. A thin elastomeric sleeve 97 of substantially the same diameter as the outside diameter of the weir-elements 82 is fitted about them and retained by clamps 92 in the grooves 76, 87 in the principal body element 71 and the outlet 81, respectively.

A sleeve rupturing device in the form of a radial piercing plate 93 is optionally provided, being carried on the three bolts 78 and longitudinally positioned in the valve by the spacers 79. Three sharp radial prongs 94 project from the element 93 and are contained within a diameter that is less than that of the upstream wall 88 of the member 80. A conduit connection 96 of a form different to that of the inlet hose adaptor 72 is provided and threaded into the outlet 81. The elastomeric sleeve 97 and with it the member 80 and weir elements 82 are housed within a perforated cylinderical member 91 which is located in a groove provided in the principal body element 71 and the outside of a radial flange on the outlet 81 and secured thereto by three screws (not shown).

In operation of the system, assuming that the helmet 11 and the pressure control means 10 are connected to a push-pull pump (not shown) on a diving bell (not shown), breathable gas is delivered to the helmet by the push-pump by way of the delivery line 13, which includes the inlet flow control valve 17, and the non-return valve 12. Gas is returned to the pull-pump from the helmet 11 by way of the helmet outlet connection 15 and the anti-suction valve 70. The non-return valve 12 prevents backflow through the helmet 11, whilst the pressure relief valve 14, incorporated in the outlet connection 15, prevents pressure rising in the helmet beyond a predetermined pressure of, say, 0.4 psi.

When the diver rises above the level of the diving bell the pull-pump is unable to accommodate return of the increasing volume of delivered breathable gas and becomes saturated at a rate that increases with height of the diver above the bell. Consequently, the difference in pressure through the anti-suction valve 70 reduces, i.e. the pressure on the downstream side of this valve increases, which increase is sensed in sub-chamber 29 of the bleed valve 19 (reference FIG. 5) by way of sensing line 37. Increasing pressure in sub-chamber 29 opposes the load that the immersing water applies to the rolling diaphragm 28 and push-rod 31 for seating the valve head 32. When the pressure in the return line at the outlet of the anti-suction valve 70 and the consequent pressure in sub-chamber 29 reach, say, −2 psi with respect to ambient (immersing water) then, together with the predetermined effort exerted by compression spring 33, the valve-head becomes unseated and allows an appropriate amount of breathable gas to bleed from the delivery line 13 and return to a region of the breathable gas source at the diving bell (which is at substantially push-pump intake pressure) by way of the duct 23, valve chamber 26 and the return line 35.

The conical construction of the valve seat 24 and the deep skirt of the valve head 32 ensure that rapid pressure changes do not occur when the valve is opened or closed so that pressure surges do not appear in the supply line 13 to affect the inlet control valve 17 and cause possible discomfort to the diver.

Thus, because the bleed valve 19 is positioned adjacent to the helmet 11 it is responsive directly to the ambient pressure thereabout, i.e. the immersing water, and consequently is able to bleed, with considerable accuracy, breathable gas from the delivery line appropriate to the excess volume created by the difference in pressure between the relative levels of the diving bell and the diver when he is at the higher level.

In operation of the inlet flow control valve 17 breathable gas passes across it in its passage from the push-pump to the helmet 11, entering and leaving by way of connections 61, 62 respectively, (see FIG. 6), that connect with supply line 13. Pressure within the helmet 11 is continuously sensed by way of the sensing tube 66 and obtains in the control pressure chamber 48 of the differential pressure sensing device 42 where it is effective upon the flexible diaphragm 55 and reacts against ambient pressure exerted by the immersing water in chamber 54. Helmet control pressure in chamber 48 is also effective upon the spool supporting impermeable flexible membrane 46 and upon corresponding membrane 47 by way of balancing tube 51 in order that the spool shall be axially balanced. The diaphragm 55 responds to differences between ambient and helmet pressures and applies a bias to the combined poppet and spool valve member 45 such as to tend to maintain in the helmet a small positive pressure of, say, 4 inches WG relative to the ambient pressure. As will be explained, the anti-suction valve 70 primarily determines the difference between helmet and ambient pressures and the bias applied to the diaphragm 55 of the inlet valve by the spring 64 is set by means of the adjuster 63 so that the inlet valve seeks to maintain the pressure difference as determined by the valve 70. When the combined poppet and spool valve member 45 is in a steady controlling mode, and merely modulating slightly in reaction to the diver's breathing while he remains at a constant depth, i.e. in an unchanging ambient pressure, it is suspended co-axially of flow chamber 50 and centrally of and free from contact with the valve seat 43 in a position to pass a small flow of gas to ventilate the helmet and enable and anti-suction valve 70 to function to maintain the required pressure in the helmet.

The principal flowpath through the valve 17 from the inlet 61 to the outlet 62 is between or adjacent to the lands 44, 53 whilst the secondary flowpath is by way of the valve head 52, when moved off its set 43, and then into the tubular centre of the combined poppet and spool valve member 45 by way of cross drillings 59, returning to the outside of the valve member again through cross drilling 60 downstream of the lands 44, 53 where the two flowpaths conjoin to exit through the outlet 62. The function of this valve 17 is to regulate flow of delivery gas into the helmet appropriate to the diver's breathing, i.e. upon his inhalation the pressure in the helmet falls and this is sensed in chamber 48 of the differential pressure sensor arrangement 42 so that the combined poppet and spool valve member 45 is moved to open further until the helmet pressure is regained and the valve returns to its steady flow position. Conversely, upon exhalation of the diver, the pressure in the helmet increases and this increase is sensed in chamber 48 so that the valve member 45 is moved towards closing and once more the desired helmet pressure is regained. In the closed position when the valve head 52 is seated upon valve seat 43 a small flow through valve 17 is maintained by way of the annular path between the two lands 44, 53 sufficient to ensure that the diver is not denied totally a supply of gas into the helmet.

The differential pressure sensor arrangement 42, by sensing ambient pressure (immersing water) in chamber 54, ensures that the inlet valve 17 operates to the same pressure datum as that to which the diver's respiratory system is subjected and that to which the anti-suction valve 70 operates. The spring adjuster 63 allows setting of the valve 17 to match the anti-suction valve 70, because it is the latter which establishes the datum pressure in the helmet 11.

Referring to the anti-suction valve 70, ambient pressure, i.e. the immersing water, is effective on the outside of the elastomeric sleeve 97 by way of the perforated cylindrical member 91 and tends to hold it on to the tubular member, whereas helmet pressure is effective in the entry of the valve as far as the upstream end of the tubular member at the face of the flow deflecting member 80. Pull pump suction pressure applies at the outlet connection 96 and interiorily into the slots 86 formed by the weir plates 82 of the tubular member. The resistance to flow through this valve 70 establishes a positive datum presssure in the helmet 11 of, say, 4 inches WG relative to ambient pressure by predetermined relationship of the restrictive area of the annular slots 86 and the tension of the elastomeric sleeve 97. Allowing for line loss, substantially this pressure difference obtains across the elastomeric sleeve 97 and tends to lift it from the surface of the tubular member; however, the suction pressure applying at the downstream side of the slots 86 tends to draw the sleeve 97 into engagement with the tubular member. The area of the sleeve 97 that is over the shim plate 90 is, of course, not subject to the downstream suction pressure and consequently the upstream pressure in this area is able more easily to lift the sleeve from contact with the tubular member and aid passage of the return flow towards the pull pump. Consider that the relevant pressures are such that the sleeve 97 is in complete contact with the cylindrical surface of the tubular member and that the pressure pattern then changes whereby the helmet pressure is sufficient to commence lifting the sleeve 97: this lift is initiated over the shim plate where the pressure holding the sleeve 97 onto the tubular member is only that effected by the immersing water and is not subject to the effects of suction applied by the pull pump, consequently the sleeve lifts initially at the upstream edge of the shim plate 90, allowing returning gas to lift the sleeve over the whole area thereof so that the gas spills sideways into the radial slots 86. As the lifting pressure gradually increases it lifts circumferentially around the weir elements 82 appropriate to the passage area of the slots 86, as required to convey the flow necessary to maintain, substantially, a helmet pressure of 4 ins. WG, relative to ambient pressure (immersing water). By lifting the sleeve 97 easily across all the slots 86 access thereto is easily obtained and so obviates the slight pressure surges that otherwise accompany the sequential uncovering of a series of such slots.

The principal sealing surface 88 of the anti-suction valve 70 is that which is normally engaged upon the sleeve 97 but should there be leakage between the surface 88 and the sleeve 97, whereby the pressure reduces in the groove upstream of the surface 88, when the sleeve will move into closing engagement with the second sealing surface 89 to prevent suction pressure appearing in the helmet 11.

Should a rupture appear in the sleeve 97 over any of the slots 86 the volume of water that can pass through these will be small and well within the capacity that the pull pump can accept without damage resulting.

The radial piercing plate 93 may be fitted to accommodate any failure which might allow a dangerous negative pressure to appear at the valve inlet, such as the unlikely mishap of a crack appearing in the flow deflecting member 80 of the tubular member, when the effects of excessive suction could appear in the helmet.

When such a piercing plate is fitted, if the sleeve is drawn inwardly in the region of the piercing plate 93 by an abnormal lowering of pressure in this region, the prongs 34 rupture the sleeve and cause the pull pump to suck water, preventing it from reducing pressure in the helmet. A non-return valve (not shown) may be incorporaed in the hose adaptor 72 as a second preventative to backflow.

What is claimed is:

1. In a deep diving breathing system having push-pull pump means for circulating a breathable gas mixture through a diving helmet, said diving helmet having a gas supply line and a gas return line, helmet pressure control means comprising inlet valve means for controlling the rate of flow of gas from said gas supply line into the helmet to said gas return line, outlet valve means in said gas return line for controlling flow of gas from said helmet to said gas return line, and bleed valve means operable in response to the difference in pressure gas flowing from the outlet valve means and the hydrostatic pressure ambient to the bleed valve means for bleeding gas from the gas supply line upstream of the inlet valve means.

2. A deep diving breathing system in accordance with claim 1, wherein said outlet valve means having an outlet, and the bleed valve means comprises a hollow valve body, said hollow valve body housing a valve head and diaphragm combination, said valve body defining a chamber, the diaphragm dividing said chamber within the valve body into two sub-chambers one of which is open to ambient hydrostatic pressure and the other of which is connected with the outlet of the outlet valve means, the valve body defining a valve seat and having a passage connecting with the gas supply line at or near its junction with the inlet valve means, the valve head being movable by the diaphragm to co-operate with said valve seat to control said passage, in the sense to open said passage in response to rising pressure at said outlet of said outlet valve means, in relation to ambient pressure.

3. A deep diving breathing system in accordance with claim 1 or claim 2, wherein the inlet valve means comprises a hollow valve body, said hollow valve body having a gas inlet port and a gas outlet port, said valve body defining an annular valve seat and an annular land therein, said valve body having flexible wall means connected near to each end thereof and a valve member supported within the valve body by said flexible wall means near to each end of the valve member, said valve member defining a valve head and an annular land thereon for co-operation with the annular valve seat and the annular land, respectively, of the hollow valve body, a differential pressure sensing means at one end of said valve body, said sensing means having a flexible diaphragm, said sensing means divided by said flexible diaphragm into an ambient pressure chamber and a control pressure chamber, the control pressure chamber being in part defined by the flexible wall means supporting the valve member at that end of the valve body, and means for communicating the control pressure chamber with said helmet to which gas flowing through the inlet valve means is supplied.

4. A deep diving breathing system in accordance with claim 1, wherein the outlet valve means comprises a gas flow regulator valve having a valve inlet, a valve outlet and a tubular member closed at one end thereof and providing a plurality of generally radial flow paths through which gas flows in passing from said valve inlet to said valve outlet, a flexible sleeve member engageable around the cylindrical surface of the tubular member, means for exposing the flexible sleeve member to ambient water pressure on the surface thereof which is away from the cylindrical surface of the tubular member, and means for permanently occluding at said cylindrical surface an arcuate portion only of at least the first of the radial flow paths meeting gas flowing through the tubular member.

5. A deep diving breathing system in accordance with claim 4, wherein the means for permanently occluding an arcuate portion of the radial flow paths through the tubular member comprises a thin shim plate formed to the curvature of the outside diameter of the tubular member and secured thereto.

6. A deep diving breathing system in accordance with claim 4 or claim 5, wherein the tubular member is formed by a plurality of weir elements, each weir element comprising an annular plate having a plane face and provided on its opposed face with two raised rings which are concentric with the axis of the plate.

7. A deep diving breathing system in accordance with claim 6, wherein one of said rings is raised from the face of the annular plate by more than the other said ring and has its circumferential continuity broken by a series of holes centred on the ring and piercing the annular plate.

8. A deep diving breathing system in accordance with claim 4, wherein said outlet valve means includes means for rupturing the flexible sleeve member in the event of failure of a component of the valve that would permit suction pressure to be applied upstream of the flexible sleeve member.

9. Deep diving apparatus including a diving bell, at least one diving suit having a diving helmet, a breathing system, comprising push-pull pump means located on the diving bell for supplying breathable gas mixture by way of a gas supply line to the helmet of a diver operating out of the bell and for returning gas from the helmet to the bell by way of a gas return line, and helmet pressure control means mounted adjacent to the helmet having inlet valve means for controlling the rate of flow of breathable gas from the gas supply line to the helmet, outlet valve means for controlling flow of gas from the helmet to the gas return line, bleed valve means and a bleed gas return line connected between said bleed valve means and said diving bell, said bleed valve means operable in response to the difference in pressure of gas flowing from the outlet valve means and the hydrostatic pressure ambient to the bleed valve means for bleeding gas from the gas supply line upstream of the inlet valve means to said bleed gas return line.

* * * * *